US007471923B2

(12) United States Patent
Amico

(10) Patent No.: US 7,471,923 B2
(45) Date of Patent: Dec. 30, 2008

(54) LINEAR FUSING NIP ZONE

(75) Inventor: Mark Steven Amico, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 165 days.

(21) Appl. No.: 11/523,263

(22) Filed: Sep. 18, 2006

(65) Prior Publication Data

US 2008/0124145 A1 May 29, 2008

(51) Int. Cl.
*G03G 15/20* (2006.01)

(52) U.S. Cl. ..... 399/329

(58) Field of Classification Search ..... 399/320, 399/328, 329, 400

See application file for complete search history.

(56) References Cited

U.S. PATENT DOCUMENTS 4,242,566 A * 12/1980 Scribner ..... 399/329 X
6,795,677 B2 * 9/2004 Berkes et al. ..... 399/329
7,200,354 B2 * 4/2007 Nakamoto et al. ..... 399/329
7,283,759 B2 * 10/2007 Takahashi et al. ..... 399/329 X

* cited by examiner

*Primary Examiner*—Sandra L Brase
(74) *Attorney, Agent, or Firm*—Kermit D. Lopez; Luis M. Ortiz; Ortiz & Lopez, PLLC

(57) ABSTRACT

An image forming apparatus defined by two flat, linear surface plates and two belts independently routed outside one of the two flat linear surface plates using a combination of rollers providing a stiff, linear, no-friction plane scalable in dimension to form the linear nip zone. The linear nip zone is further defined having and entrance defined by entrance rollers operating within each of the two belts and an exit defined by exit rollers operating within each of the two belts. Force loading devices associated with each of the two flat linear surface plates provide a load required for the two flat linear surface plates to enable the linear nip zone to achieve proper image performance. At least one heater roller can be associated with each of the two belts for providing heat directly to a surface the two belts that will directly contact paper processed through the linear nip zone.

14 Claims, 5 Drawing Sheets

LINEAR FUSING NIP ZONE

TECHNICAL FIELD

Embodiments are generally related to image processing. Embodiments are also related to the field of nipping mechanisms. Embodiments are additionally related to linear fusing in nipping mechanisms.

BACKGROUND OF THE INVENTION

Processes and devices have been used for image processing in which a nipping mechanism can be applied to an image processing apparatus which is being represented by electro photographic copiers, laser printers or facsimile machines. A nipping mechanism is usually provided in a fixing device disposed downstream from a transfer belt for transporting a sheet having a toner image transferred through a photosensitive drum. A nipping mechanism comprises a fixing roller having a heater embedded therein, and a pressure roller disposed in opposed relation to the fixing roller while allowing the lower portion thereof to be in close contact with the fixing roller.

In such an electrographic apparatus generally a fixing device in a two-roll system composed of a heating roll and a pressure roll, that is being kept in contact with each other, is employed passing through the recording medium over the surface. An unfixed toner image can be formed through the nip zone. A nip zone is formed when the recording medium is in contact with both rolls. Then the toner in the electrographic apparatus is molten by heat and pressure so that the toner image is fixed on the surface of the recording medium as a permanent image. As the case may be in place of the heating roll and pressure roll, the heating member of each has an endless belt shape.

As xerographic imaging systems continue to increase in speed, the need to provide an adequate nip width to a fuser toner and then to a media also increases. Referring to FIG. 1, labeled as prior-art, a graph 100 illustrates traditional roll pairs. The graph shows that traditional roll pairs are limited due to a relationship between roll diameters, elastomer thickness, and the available load. For example, to achieve a 30 ms (milliseconds) dwell time when a 100 ppm (pulse position modulation) rate is required, a nip width of 14.04 mm (millimeters) is required. As speeds increase to 150 ppm, an equivalent nip grows to 21.06 m. At 200 ppm the nip width is 28.08 mm. In the graph the load (pounds) 102 defines the horizontal axis and dwell time (ms) 104 defines the vertical axis. The graph also shows the representations in specific values 106 when plotted.

Hence there is a need to provide an adequate nip width to a fuser toner by using a nipping mechanism. As xerographic imaging systems continue to increase in speed, a nipping mechanism with fusing enhancement that can be used in image processing for providing improved performance is needed. Ideally the sheet nipping mechanism and nipping mechanism for fixing devices can be enhanced by using a method of linear fusing in nipping mechanism.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an improved image forming apparatus.

It is another aspect of the present invention to provide for an improved nipping mechanism.

It is a further aspect of the present invention to provide for an improved image performance by providing a fusing nip mechanism.

It is a further aspect of the present invention to provide for an improved image performance by providing a fusing nip mechanism.

The aforementioned aspects and other objectives and advantages can now be achieved as described herein. An image forming apparatus defined by two flat, linear surface plates and two belts independently routed outside one of the two flat linear surface plates using a combination of rollers providing a stiff, linear, no-friction plane scalable in dimension to form the linear nip zone. The linear nip zone is further defined having and entrance defined by entrance rollers operating within each of the two belts and an exit defined by exit rollers operating within each of the two belts. Force loading devices associated with each of the two flat linear surface plates provide a load required for the two flat linear surface plates to enable the linear nip zone to achieve proper image performance. At least one heater source (e.g., a heat roller) can be associated with each of the two belts for providing heat onto surfaces of the two belts that will directly contact paper processed through the linear nip zone.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
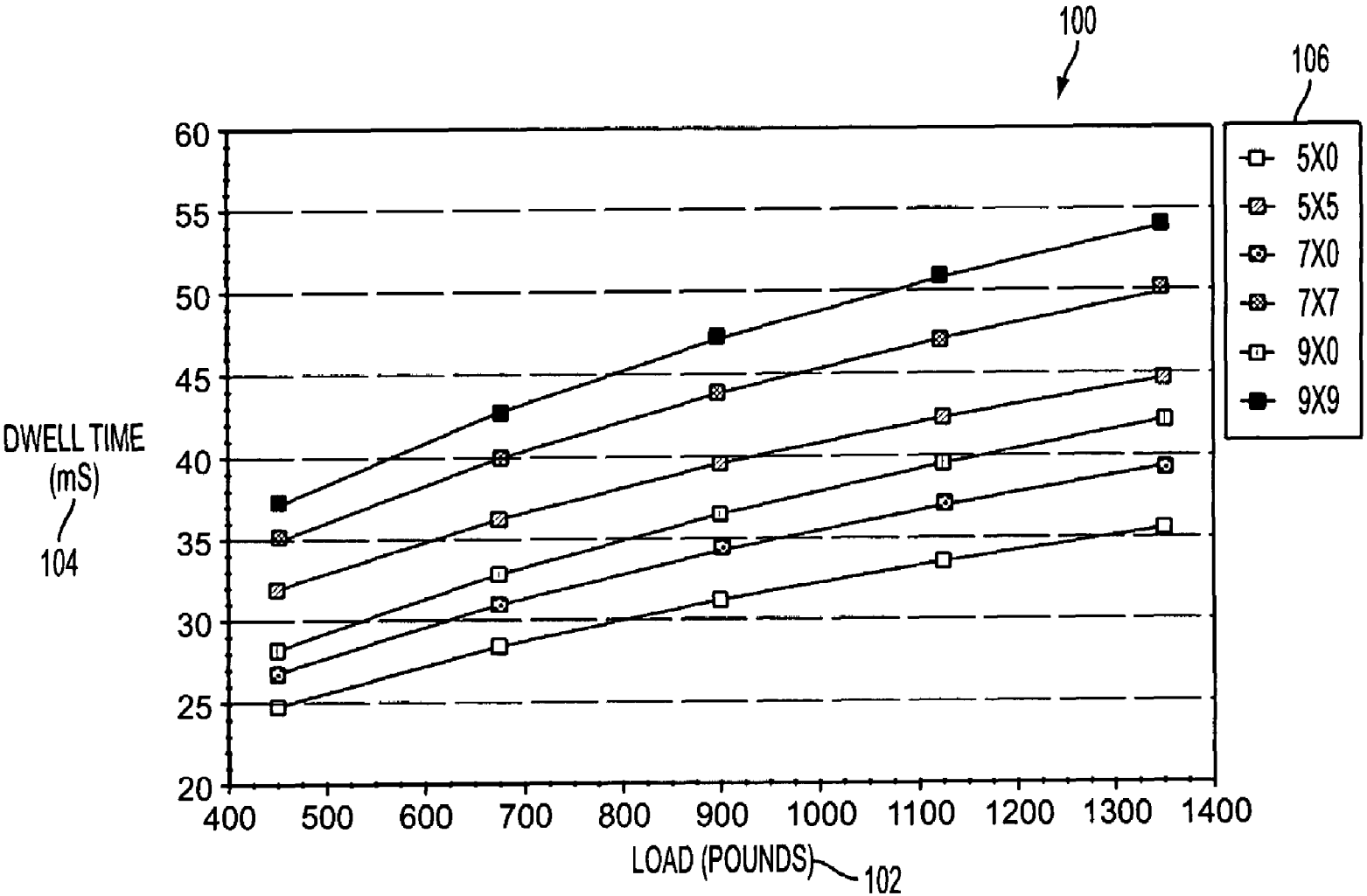
FIG. 1 PRIOR ART
FIG. 1, labeled "prior art", illustrates a graph representation showing traditional roll pairs with reference to load and dwell time used for nipping mechanisms.
Figure 2:
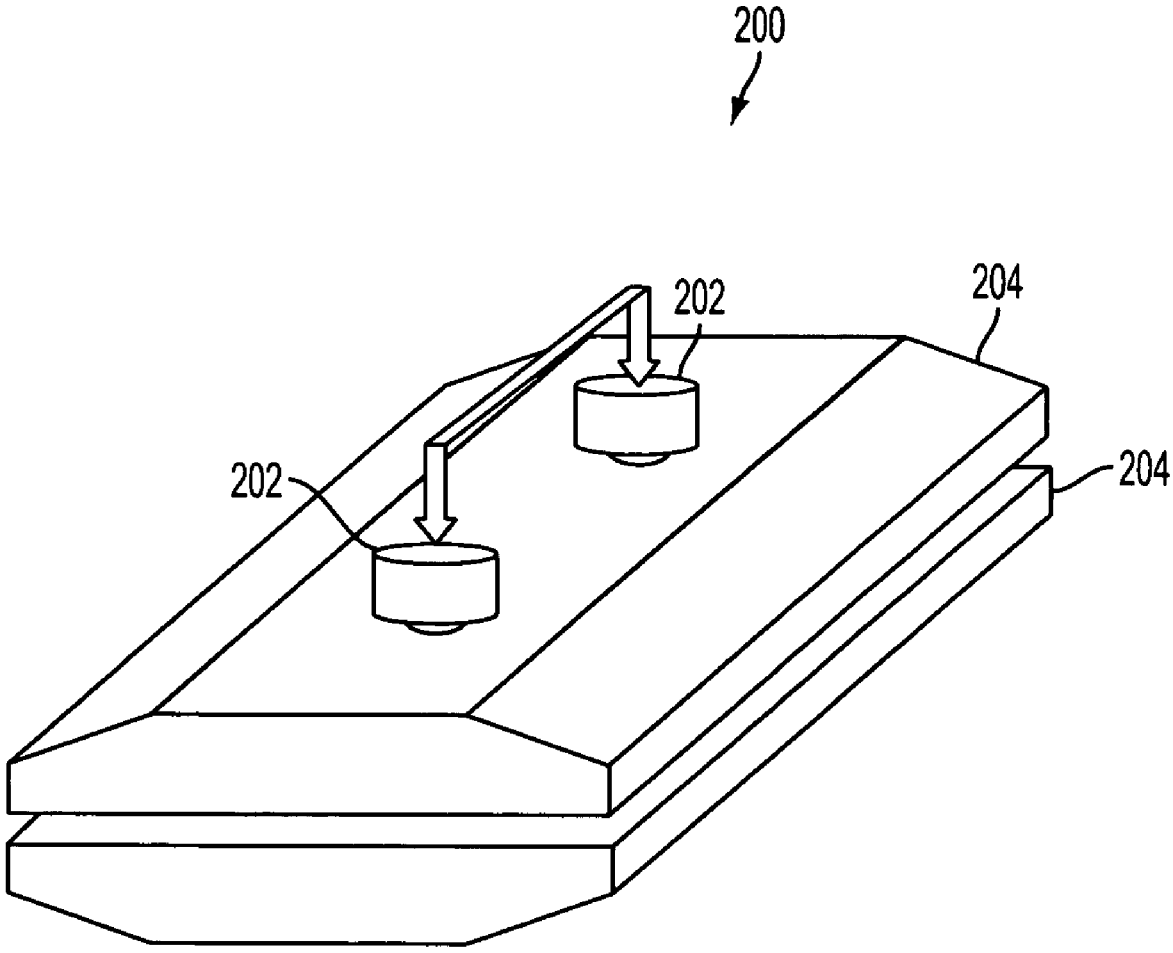
FIG. 2 illustrates a perspective view of an image forming apparatus of a linear fusing nip zone, in accordance with a preferred embodiment.

Referring to FIG. 2, illustrated is a perspective view 200 of an image forming apparatus of a linear fusing nip zone, in accordance with a preferred embodiment. The tracking rollers 202 are placed in context with the linear air bearing surface plates 204.

Figure 3:
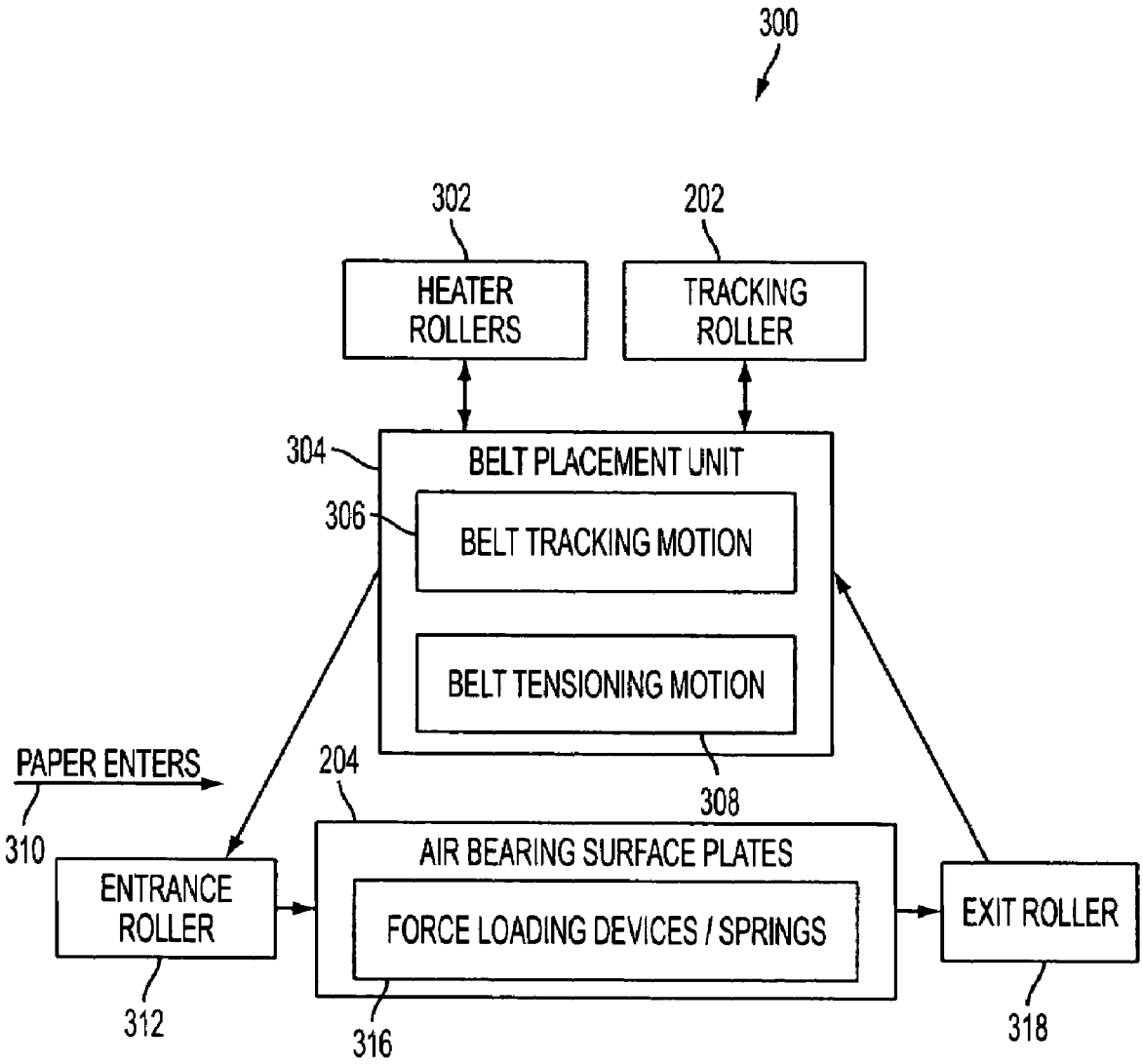
FIG. 3 illustrates a block diagram of a linear fusing nip zone, in accordance with a preferred embodiment.

Referring to FIG. 3, illustrated is a block diagram 300 of a linear fusing nip zone, in accordance with a preferred embodiment. In this system paper enters 310 into an image forming apparatus with the help of an entrance roller 312. The entrance roller 312 is configured and set with two opposing unheated flat air bearing surface plates 204 for creating an extended linear zone. The flat air bearing surface plates provide a zero media-bend zone for fusing. Each flat air bearing surface plate is supported by one or more springs, or force loading devices 316, thereby providing the load required for achieving proper image performance when an image is being processed. The belt placement unit 304 includes two independent non-permeable belts for creating the fusing nip zone. The belts are controlled by belt tracking motion 306 and belt tensioning motion 308. The heater rollers 302 and a tracking roller 202 are shown in contact with the belts for heating and running the belt when printing is being done. The heater rollers 302 are ideally positioned to directly heat the surface of the side of the belt that comes into contact with paper during linear fusing nip zone operation. Although heat rollers 302 are shown, it should be appreciated that the rollers do not need to be heated and that another heat source, such as a heat lamp, could be used to heat the surface of the belts that comes into direct contact with the medium (paper). The exit roller 318 acts as an output interface through which the printed paper is sent out of the image forming apparatus of a linear fusing nip zone.

Figure 4:
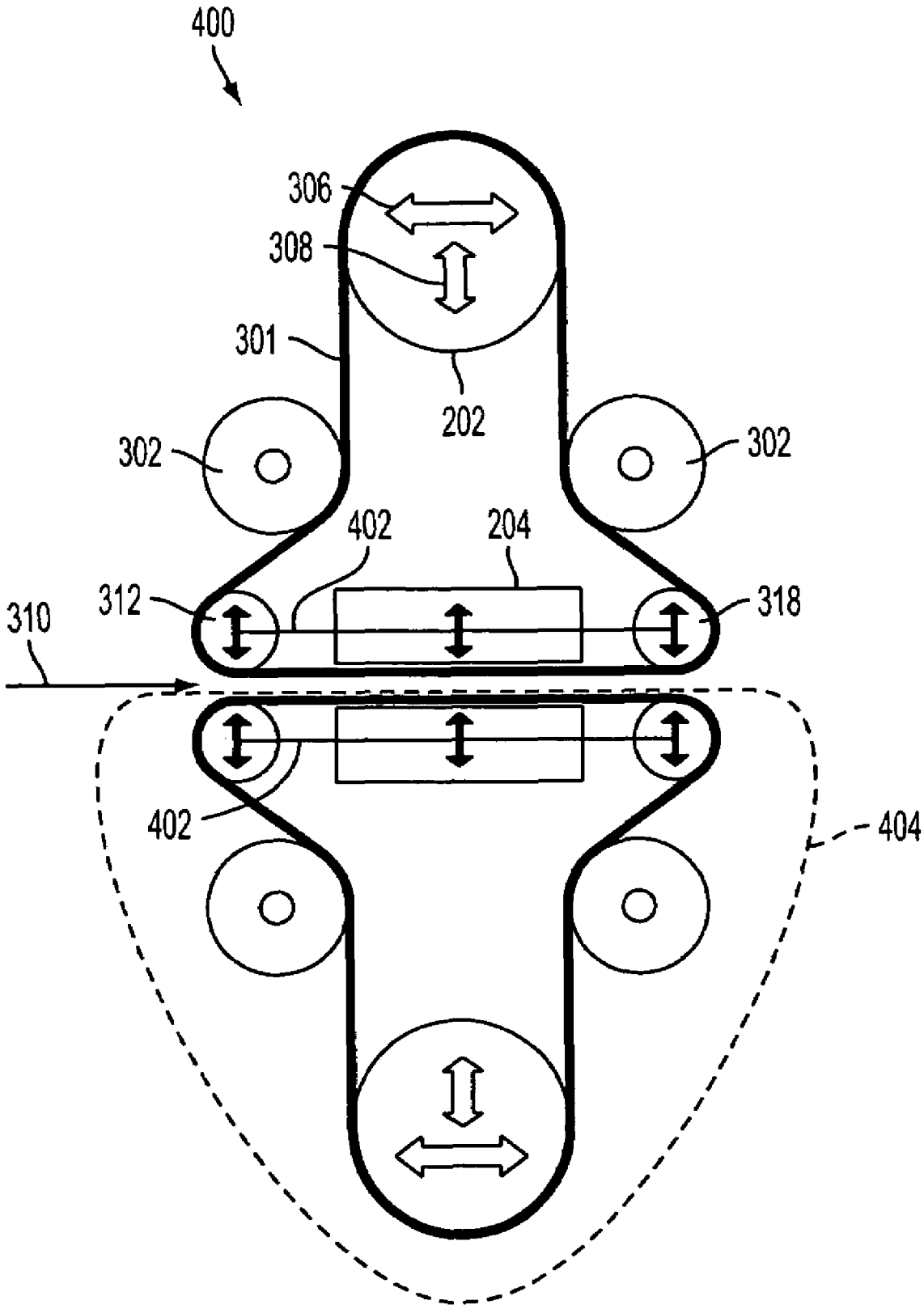
FIG. 4 illustrates a sectional view with the usage of two opposing flat air bearings to create a linear nip of a linear fusing nip zone, in accordance with a preferred embodiment.

Referring to FIG. 4, illustrated is a sectional view of a nipping mechanism 400 using two opposing sections. The design encircled by the dashed line 404 is located below a mirror image of components that make of the upper section of the nipping mechanism. In accordance with the embodiment, flat air bearing surface plates 204 create part of a linear nip of a linear fusing nip zone. A nipping mechanism 400 uses two opposing unheated flat linear air bearing surface plates 204 to create an extended linear zone wherein two independent non-permeable belts 301 travel between thereby creating the fusing nip zone. The belts 301 are controlled by belt tracking motion control 306 and by belt tensioning motion control 308 over tracking rollers 202. The heater rollers 302 and tracking rollers 202 are set for running the belts 301 when printing is being done in an image forming zone created between the outside surface of belts 301 within the linear fusing nip zone. During operation, paper 310 can enter into the processing unit with the help of the belts 301 and entrance rollers 312. The entrance rollers 312 are further configured and set with two opposing unheated flat air bearing surface plates 204 and thereby create an extended linear zone. The loading operation in the image forming apparatus of a linear fusing nip zone moves in tandem to enable jam clearance 402 in-between the entrance rollers 312 and the linear flat air bearing surface plates 204.

Flat air bearing surface plates 204 provide a zero media-bend zone for fusing. These flat air bearing surface plates 204 are appropriate for highly loaded applications. Each flat air bearings plate 204 can be supported by one or more springs, or force-loading devices, thereby providing the load required for achieving proper media handling and performance through the system 400. The force-loading device provided by the combination of rollers and belts 301 provide a means for removing any tolerance stack-ups and parallelism issues in an image forming apparatus of a linear fusing nip zone. The exit rollers 318 act as an output interface through which the printed paper is sent out of the image forming apparatus of the linear fusing nip zone.

Fusing of images onto paper can be more effective using the embodiment shown in FIG. 4 because the belts 301 are heated directly on their outer surface by a heat source such as the heater rollers 302, before the belts 301 come into direct contact with paper within the fusing nip zone. Other heat source can be used to accomplish heating of the outer surface of belts 30, such as a heat lamp and other heat source known in the art. Heated rollers, however, are ideal because less heat is generated within the system housing by direct contact with heated rollers as opposed to a radiating heat source. In prior art devices, heat is generated on the belt using a heat source located opposite the contact surface of the belts 301. Heat applied to the backside of a belt, opposite the contacting surface of the belt, relies on heat transfer to warm the contact surface, which is a less efficient way to heat a belt and also results in unwanted heat generation within the overall system compartment or housing.

Figure 5:
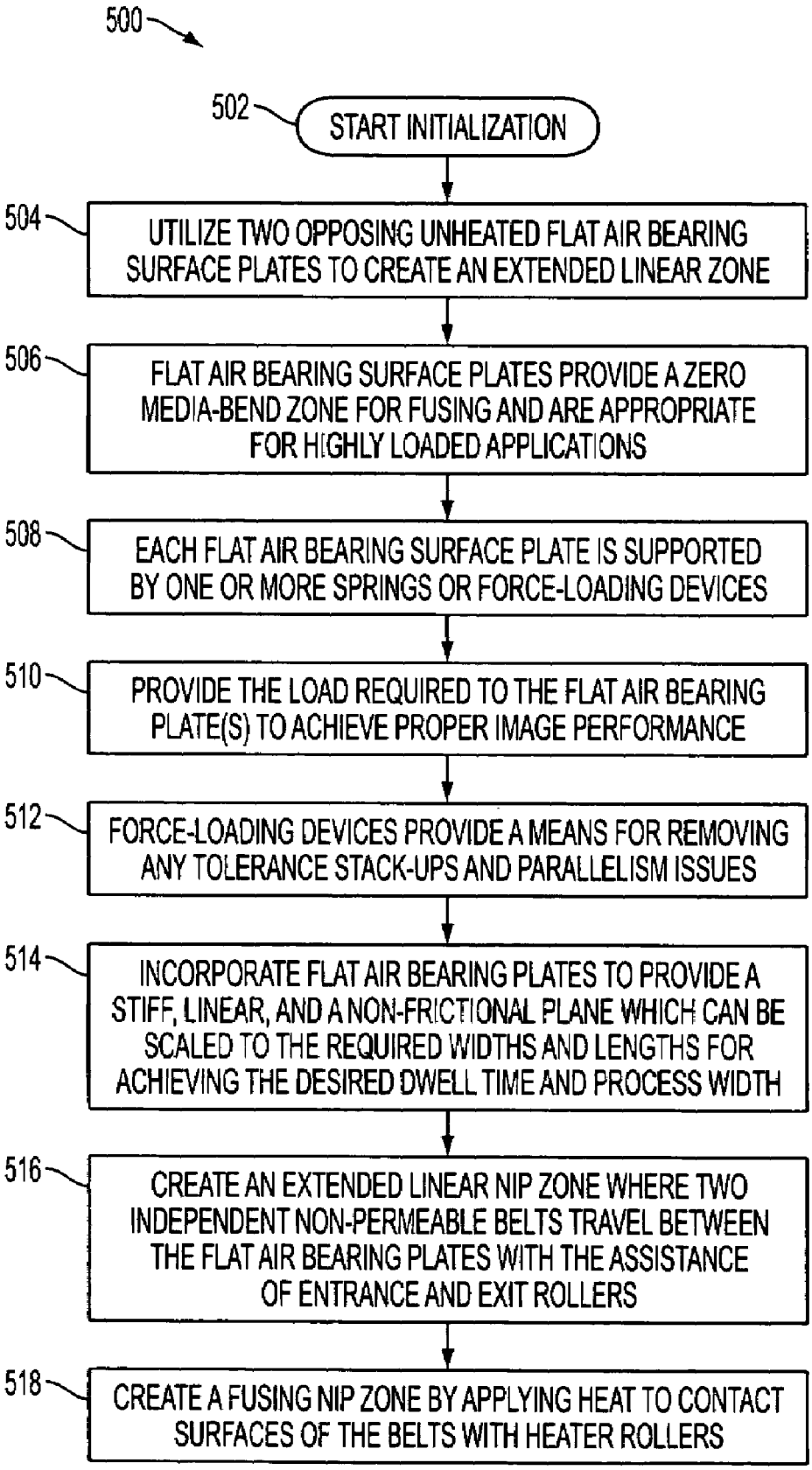
FIG. 5 illustrates a high-level flow chart showing the functionality of a linear fusing nip zone, in accordance with a preferred embodiment.

Referring to FIG. 5, illustrates a high-level flow chart 500 showing the functionality of a linear fusing nip zone, in accordance with a preferred embodiment. As depicted at block 502, initialization can occur. Next, as indicated in block 504, two opposing unheated flat air bearing surface plates are utilized to create an extended linear zone. Flat air bearing surface plates provide a zero media-bend zone for fusing and are appropriate for highly loaded applications as indicated in block 506. Thereafter as described in block 508, each flat air bearing surface plate is supported by one or more springs or force loading devices. The load required for achieving proper image performance is provided to the flat air bearing surface plates by the one or more springs or force loading devices as indicated in block 510. Force loading devices can also be used for providing a means for removing any tolerance stack ups and parallelism issues as depicted in block 512. Flat air bearing plates are incorporated in the system to provide a stiff, linear and a non-frictional plane which can be scaled to required widths and lengths for achieving the desired dwell time and process width as described in block 514. An extended linear nip zone is further created where two independent non permeable belts travel between the flat air bearing plates with the assistance of entrance rollers and exit rollers as indicated in block 516. Finally, a heated fusing nip zone is created by application of heat to contact surfaces of the belts with heater rollers as indicated in block 518.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An image forming apparatus, comprising:

two flat, linear surface plates; and two belts independently routed outside one of said two flat linear surface plates using a combination of rollers;

wherein said two belts and said flat linear surface plates surrounded by said two belts provide a stiff, linear, no-friction plane scalable in dimension to form a linear nip zone.

2. The image forming apparatus of claim 1, wherein said linear nip zone is further defined by having an entrance defined by entrance rollers operating within each of said two belts and an exit defined by exit rollers operating within each of said two belts.

3. The image forming apparatus of claim 2, further comprising force loading devices associated with each of said two flat linear surface plates, said force loading devices providing a load required for said two flat linear surface plates to enable the linear nip zone to achieve proper image performance.

4. The image forming apparatus of claim 2, wherein said two belts are non-permeable belts.

5. The image forming apparatus of claim 1, further comprising force loading devices associated with each of said two flat linear surface plates, said force loading devices providing a load required for said two flat linear surface plates to enable the linear nip zone to achieve proper image performance.

6. The image forming apparatus of claim 5, wherein said linear nip zone is further defined by having and entrance defined by entrance rollers operating within each of said two belts and an exit defined by exit rollers operating within each of said two belts.

7. The image forming apparatus of claim 1, further comprising at least one heat source associated with each of said two belts, said at least one heat source providing heat directly to a surface said two belts that will directly contact paper processed through the linear nip zone.

8. The image forming apparatus of claim 7, further comprising force loading devices associated with each of said two flat linear surface plates, said force loading devices providing a load required for said two flat linear surface plates to enable the linear nip zone to achieve proper image performance.

9. The image forming apparatus of claim 8, wherein said linear nip zone is further defined by having and entrance defined by entrance rollers operating within each of said two belts and an exit defined by exit rollers operating within each of said two belts.

10. An image forming apparatus comprising:

two unheated flat linear air bearing surface plates providing a stiff, linear, no-friction plane that is scalable to a specified width and length for achieving a desired dwell time and process width as part of forming a linear nip zone; and two independent non-permeable belts, each routed outside of one of the two unheated flat linear air bearing surface plates using a combination of rollers, said two unheated flat linear air bearing surface plates, two independent non-permeable belts defining a nip zone having and entrance defined by entrance rollers operating with each of said two independent non-permeable belts and an exit defined by exit rollers operating within each of said two independent non-permeable belts.

11. The image forming apparatus of claim 10, further comprising force loading devices associated with each of said two unheated flat linear air bearing surface plates, said force loading devices providing a load required for said plates to enable the nip zone to achieve proper image performance.

12. The image forming apparatus of claim 11, further comprising at least one heater roller associated with each of said two independent non-permeable belts, said at least one heater roller providing heat directly to a surface said two independent non-permeable belts that will directly contact paper processed through the nip zone.

13. The image forming apparatus of claim 10, further comprising at least one heater roller associated with each of said two independent non-permeable belts, said at least one heater roller providing heat directly to a surface said two independent non-permeable belts that will directly contact paper processed through the nip zone.

14. The image forming apparatus of claim 13, further comprising force loading devices associated with each of said two unheated flat linear air bearing surface plates, said force loading devices providing a load required for said plates to enable the nip zone to achieve proper image performance.

* * * * *